US010232651B2

(12) United States Patent
Lim et al.

(10) Patent No.: US 10,232,651 B2
(45) Date of Patent: Mar. 19, 2019

(54) THERMAL PRINTER WITH HEAT CONTROLLER

(71) Applicant: TOSHIBA TEC KABUSHIKI KAISHA, Tokyo (JP)

(72) Inventors: Chen Pang Lim, Singapore (SG); Noriyuki Watanabe, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/875,315

(22) Filed: Jan. 19, 2018

(65) Prior Publication Data

US 2018/0222222 A1 Aug. 9, 2018

(30) Foreign Application Priority Data

Feb. 6, 2017 (JP) ..... 2017-019530

(51) Int. Cl.

| | |
|---|---|
| ***B41J 2/36*** | (2006.01) |
| ***B41J 13/00*** | (2006.01) |
| ***B41J 2/355*** | (2006.01) |
| ***B41J 2/365*** | (2006.01) |
| ***B41J 15/04*** | (2006.01) |
| ***B41J 2/32*** | (2006.01) |

(52) U.S. Cl.

CPC ..... *B41J 13/0009* (2013.01); *B41J 2/32* (2013.01); *B41J 2/355* (2013.01); *B41J 2/365* (2013.01); *B41J 15/042* (2013.01)

(58) Field of Classification Search

CPC . B41J 13/0009; B41J 2/32; B41J 2/365; B41J 2/355; B41J 15/042

See application file for complete search history.

(56) References Cited

U.S. PATENT DOCUMENTS

| | | | | |
|---|---|---|---|---|
| 8,179,409 | B2 * | 5/2012 | Saga | B41J 2/355 347/190 |
| 8,670,010 | B2 | 3/2014 | Kano | |
| 2009/0009579 | A1 * | 1/2009 | Yamazaki | B41J 2/36 347/194 |

FOREIGN PATENT DOCUMENTS

| | | |
|---|---|---|
| JP | H10-193664 | 7/1998 |
| JP | 2009-113445 | 5/2009 |
| WO | 2012/132987 | 10/2012 |

OTHER PUBLICATIONS

Computer-generated translation of JP 2009-113445, published on May 2009.*

* cited by examiner

*Primary Examiner* — Huan Tran

(74) *Attorney, Agent, or Firm* — Kim & Stewart LLP

(57) ABSTRACT

A thermal printer according to an embodiment includes a communication interface that receives print data from an external device. A thermal print head thermally prints on a sheet, line by line according to the received print data. A motor drives a roller to transport the sheet, line by line according to the received print data. A processor determines, for a current print line, a target transport speed for transporting the sheet, and retrieves one or more intermediate speeds that are defined in advance and are between a current transport speed of transporting the sheet and the target transport speed. The processor controls the motor to transport the sheet at each determined intermediate speed and the target transport speed, sequentially. The thermal print head is heated in accordance with predetermined heating control information corresponding to the determined intermediate speed closest to the current speed.

20 Claims, 7 Drawing Sheets

FIG. 3
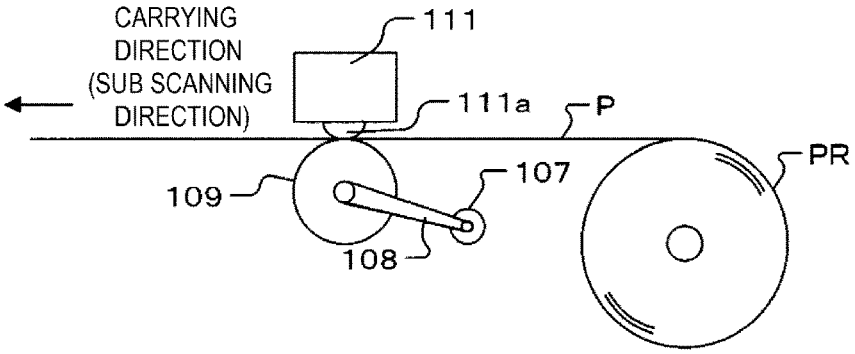
FIG. 4
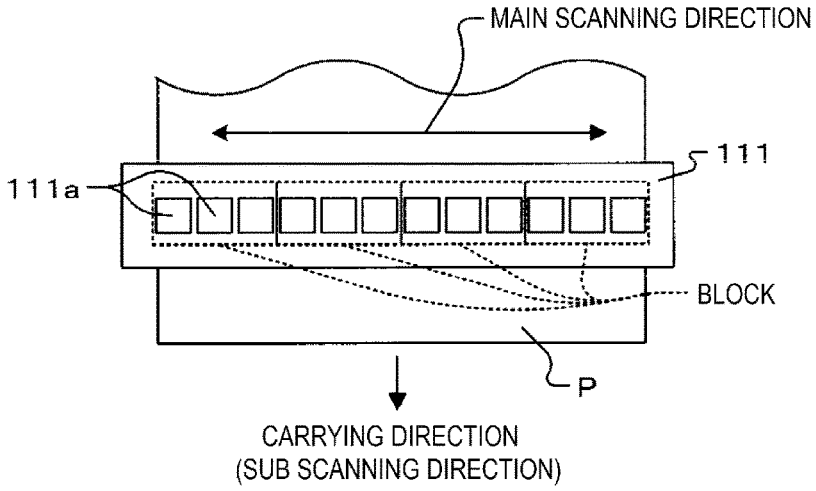
FIG. 5
| No. | PRINT RATE R(%) | CARRYING SPEED V(IPS) | CARRYING PULSE MF |
|---|---|---|---|
| 1 | 0≤R<Ra | 14. 0 | MF1 |
| 2 | Ra≤R<Rb | 10. 0 | MF2 |
| 3 | Rb≤R<Rc | 8. 0 | MF3 |
| 4 | Rc≤R<Rd | 6. 0 | MF4 |
| 5 | Rd≤R<Re | 4. 0 | MF5 |
| 6 | Re≤R<Rf | 2. 0 | MF6 |
| 7 | Rf≤R≤100 | 1. 0 | MF7 |
(CARRYING SPEED DATA)

FIG. 6

| No. | TRANSPORT SPEED V(IPS) | HEAT GENERATING ELEMENT ENERGIZING PULSE WIDTH ET | NUMBER OF ENERGIZED HEAT GENERATING ELEMENT BLOCKS |
|---|---|---|---|
| 1 | 14. 0 | ET1 | 1 |
| 2 | 10. 0 | ET2 | |
| 3 | 8. 0 | ET3 | |
| 4 | 6. 0 | ET4 | 2 |
| 5 | 4. 0 | ET5 | |
| 6 | 2. 0 | ET6 | 4 |
| 7 | 1. 0 | ET7 | |

(CONTROL DATA FOR CONSTANT-SPEED PHASE)

FIG. 7

| No. | TRANSPORT SPEED V(IPS) | HEAT GENERATING ELEMENT CONTROL INFORMATION | |
|---|---|---|---|
| | | HEAT GENERATING ELEMENT ENERGIZING PULSE WIDTH ET | NUMBER OF ENERGIZED HEAT GENERATING ELEMENT BLOCKS |
| 1 | 10. 0<V≤14. 0 | (MF1/Current MF) * ET1 | 1 |
| 2 | 8. 0<V≤10. 0 | (MF2/Current MF) * ET2 | |
| 3 | 6. 0<V≤8. 0 | (MF3/Current MF) * ET3 | |
| 4 | 4. 0<V≤6. 0 | (MF4/Current MF) * ET4 | 2 |
| 5 | 2. 0<V≤4. 0 | (MF5/Current MF) * ET5 | |
| 6 | 1. 0<V≤2. 0 | (MF6/Current MF) * ET6 | 4 |
| 7 | 0≤V≤1. 0 | (MF7/Current MF) * ET7 | |

(CONTROL DATA FOR VARIABLE-SPEED PHASE)

FIG. 8

| TRANSPORT SPEED V(IPS) | STEP | TRANSPORT PULSE MF | HEAT GENERATING ELEMENT ENERGIZING PULSE WIDTH ET | NUMBER OF ENERGIZED HEAT GENERATING ELEMENT BLOCKS |
|---|---|---|---|---|
| 10.0<V≤14.0 | 1 | MF11 | ET11 | 1 |
| | 2 | MF12 | ET12 | |
| | 3 | MF13 | ET13 | |
| | 4 | MF14 | ET14 | |
| | 5 | MF15 | ET15 | |
| | 6 | MF16 | ET16 | |
| | 7 | MF17 | ET17 | |
| | 8 | MF18 | ET18 | |
| 8.0<V≤10.0 | 9 | MF21 | ET21 | |
| | 10 | MF22 | ET22 | |
| | 11 | MF23 | ET23 | |
| | 12 | MF24 | ET24 | |
| 6.0<V≤8.0 | 13 | MF31 | ET31 | |
| | 14 | MF32 | ET32 | |
| | 15 | MF33 | ET33 | |
| | 16 | MF34 | ET34 | |
| 4.0<V≤6.0 | 17 | MF41 | ET41 | 2 |
| | 18 | MF42 | ET42 | |
| | 19 | MF43 | ET43 | |
| | 20 | MF44 | ET44 | |
| 2.0<V≤4.0 | 21 | MF51 | ET51 | |
| | 22 | MF52 | ET52 | |
| | 23 | MF53 | ET53 | |
| | 24 | MF54 | ET54 | |
| 1.0<V≤2.0 | 25 | MF61 | ET61 | 4 |
| | 26 | MF62 | ET62 | |
| 0≤V≤1.0 | 27 | MF71 | ET71 | |
| | 28 | MF72 | ET72 | |

THERMAL PRINTER WITH HEAT CONTROLLER

CROSS-REFERENCE TO RELATED APPLICATION

This application is based upon and claims the benefit of priority from Japanese Patent Application No. 2017-019530, filed Feb. 6, 2017, the entire contents of which are incorporated herein by reference.

FIELD

Embodiments described herein relate generally to a thermal printer with a heat controller.

BACKGROUND

A thermal printer used for a POS (point-of-sale) terminal controls the transport speed of a recording medium such as a receipt paper according to the print rate of print data printed on the recording medium. Also, the thermal printer includes a plurality of heat generating elements arrayed in a direction orthogonal to the transport direction, and drives the heat generating elements, based on a pulse signal with a predetermined pulse width corresponding to the transport speed.

The thermal printer needs to properly control the heat generating elements until a target transport speed is reached. If control information for the heat generating elements is provided for each available transport speed in combination with a target transport speed, the number of pieces of control information of the heat generating elements increases as the number of available transport speeds increases. For example, if there are three available transport speeds, six pieces of control information are needed.

In view of the foregoing, a transport speed control device that can reduce the number of pieces of control information of the heat generating elements until a target transport speed is reached, while maintaining the number of available transport speeds, is desirable.

DESCRIPTION OF THE DRAWINGS

FIG. 3 illustrates the relationship of the arrangement positions of a platen roller and a thermal head.

FIG. 4 illustrates the thermal head, as viewed from above.

FIG. 5 illustrates transport speed data.

FIG. 6 illustrates control data for constant-speed phase.

FIG. 7 illustrates control data for variable-speed phase.

FIG. 8 illustrates control data for variable-speed phase in which the pulse width of a heat generation pulse signal is determined for each step.

DETAILED DESCRIPTION

Figure 1:
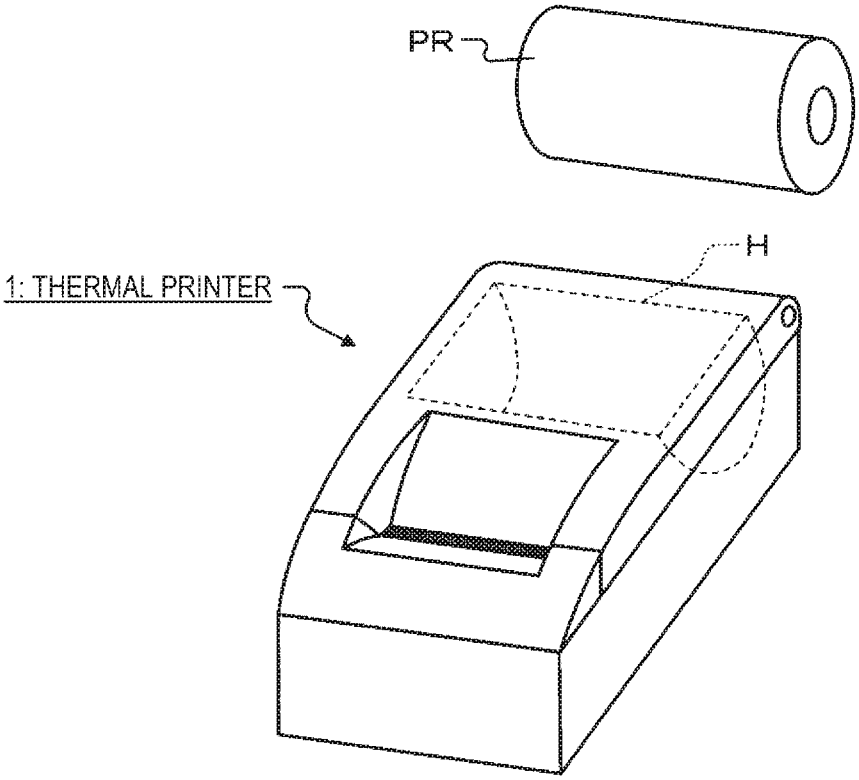
FIG. 1 is a perspective view of a thermal printer according to an embodiment.

A thermal printer according to an embodiment includes a communication interface that receives print data from an external device. A thermal print head thermally prints on a sheet, line by line according to the received print data. A motor drives a roller to transport the sheet, line by line according to the received print data. A processor determines, for a current print line, a target transport speed for transporting the sheet, and retrieves one or more intermediate speeds that are defined in advance and are between a current transport speed of transporting the sheet and the target transport speed. The processor also retrieves, for each determined intermediate speed, predetermined heating control information for heating the thermal print head. The processor controls the motor to transport the sheet at each determined intermediate speed and the target transport speed, sequentially. The thermal print head is heated in accordance with the predetermined heating control information corresponding to the determined intermediate speed closest to the current speed.

Hereinafter, an embodiment will be described with reference to the drawings. A thermal printer with a heat generation controller according to this embodiment is used for a POS (point of sales) terminal. In the drawings, the same or equivalent parts are denoted by the same reference signs.

As illustrated in FIG. 1, a thermal printer 1 includes a holder H which removably stores and holds a roll paper PR. The roll paper PR is a roll of thermosensitive paper which develops color by being heated. The leading edge of the roll paper PR held by the holder H is transported in a direction orthogonal to the axis of rotation of the roll paper PR from the distal end thereof, and information such as a transaction statement (contents of purchased products) is printed on the transported paper.

The thermal printer 1 controls the transport speed of the paper according to the print rate of print data representing the transaction statement information. The thermal printer 1 also has a plurality of heat generating elements arrayed in a line in a direction (main scanning direction) orthogonal to the transport direction (sub scanning direction). The thermal printer 1 controls the heat generating elements according to the transport speed.

Figure 2:
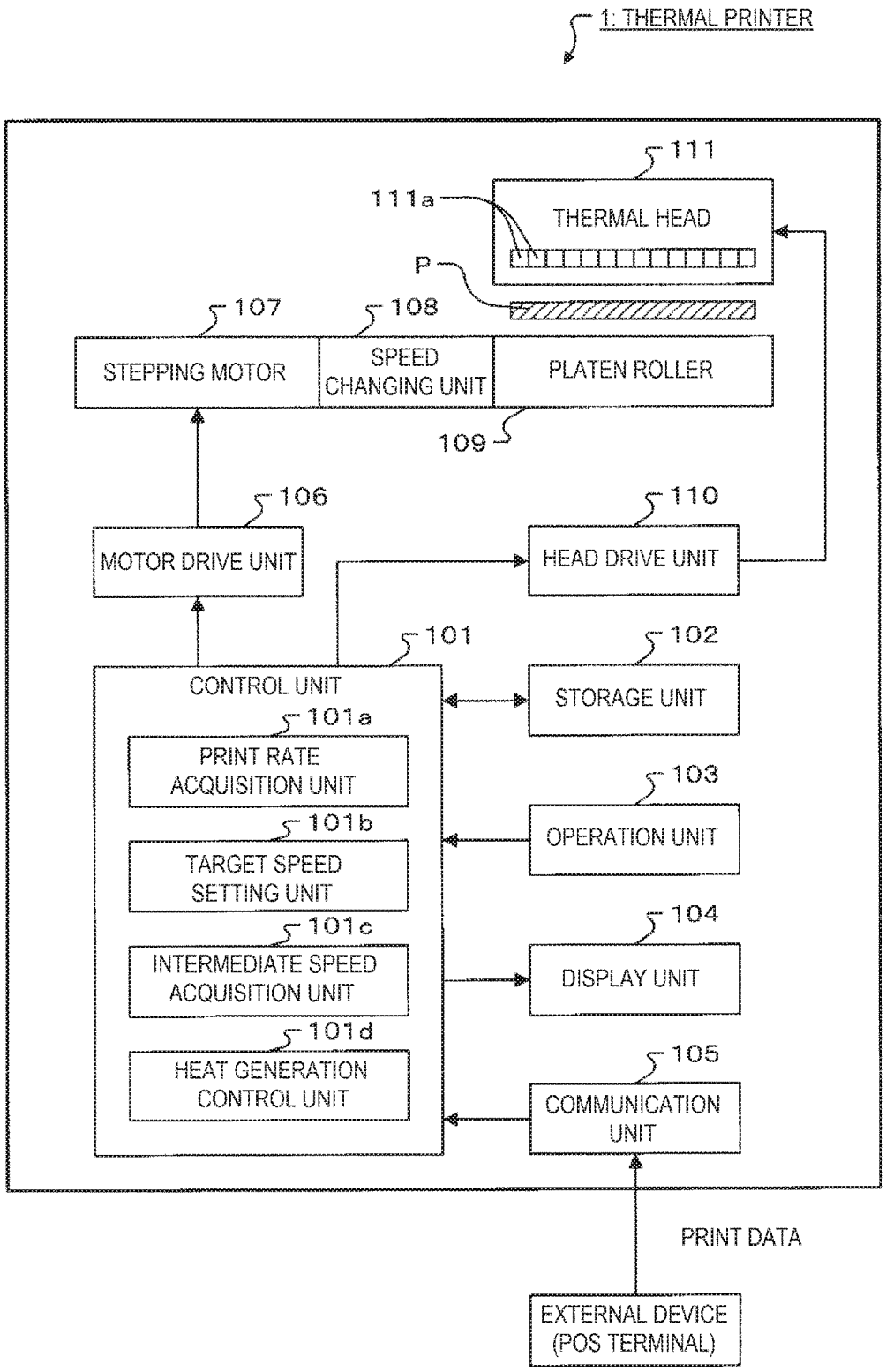
FIG. 2 is a block diagram showing the configuration of the thermal printer.

As illustrated in FIG. 2, the thermal printer 1 includes a control unit 101, a storage unit 102, an operation unit 103, a display unit 104, a communication unit 105, a motor drive unit 106, a stepping motor (pulse motor) 107, a speed changing unit 108, a platen roller 109, a head drive unit 110, and a thermal head 111.

The operation unit 103 may be an input interface operated by the user, such as a cover open-close button for loading and removing the roll paper PR, a power button for switching on and off the power of the thermal printer 1, a feed button for transporting a paper P, or a cut button for cutting the paper.

The display unit 104 includes a display device such as a liquid crystal display, and a lighting device such as an LED (light emitting diode). The display unit 104 displays information showing various states of the thermal printer 1. For example, the display unit 104 displays the state of print execution, the open-close state of the cover, the amount of paper remaining in the roll paper PR, and the like.

The communication unit 105 is a communication interface which communicates with an external device such as a POS (point of sales) terminal. The communication unit 105 receives print data representing information such as transaction details from the external device via a network. The communication unit 105 supplies the received print data to the control unit 101. The communication unit 105 may communicate with the external device vie either wired or wireless communication.

The motor drive unit 106 supplies a transport pulse signal to the stepping motor 107 under the control of the control unit 101, and thus drives the stepping motor 107.

The stepping motor 107 receives the transport pulse signal from the motor drive unit 106 and rotates by an amount per pulse that is defined in advance, according to the received transport pulse signal.

The speed changing unit 108 includes a speed reduction mechanism including a plurality of gears or the like. The speed changing unit 108 is provided between the stepping motor 107 and the platen roller 109. The speed changing unit 108 transmits the rotational force of the stepping motor 107 to the platen roller 109 and thus causes the platen roller 109 to rotate.

The platen roller 109 rotates by the rotational force of the stepping motor 107 transmitted thereto via the speed changing unit 108. Also, the platen roller 109 is provided at a position that faces the thermal head 111, as shown in FIG. 3. The paper P, that is, the leading end of the roll paper PR, is carried in the transport direction (sub scanning direction) by the rotation of the platen roller 109.

The head drive unit 110 supplies a heat generation pulse signal (strobe signal) to the thermal head 111 under the control of the control unit 101 and thus drives a plurality of heat generating elements 111*a* provided in the thermal head 111.

The thermal head 111 receives the heat generation pulse signal from the head drive unit 110 and prints one dot line on the paper P at a position that faces the platen roller 109, in response to the received heat generation pulse signal.

The respective heat generating elements 111*a* are arrayed in a line in the direction (main scanning direction) orthogonal to the transport direction, as shown in FIG. 4. The respective heat generating elements 111*a* are selectively driven by the heat generation pulse signal and thus generate heat. Also, the respective heat generating elements 111*a* are divided into a plurality of blocks (element groups) and driven in a time-divisional manner for each dot line of the print data to be printed. FIG. 4 shows an example in which the plurality of heat generating elements 111*a* is divided into four blocks (element groups) and driven on a block basis under the control of the control unit 101.

The storage unit 102 is a storage device such as an HDD (hard disk drive), a ROM (read only memory), or a flash memory. The storage unit 102 stores programs and data for the control unit 101 to carry out various kinds of processing, and data generated and acquired by the execution of various kinds of processing by the control unit 101.

Also, the storage unit 102 stores data (transport speed data) associating a range of print rate, a transport speed and a transport frequency (PPS (pulse rate)), as shown in FIG. 5. Thus, a target transport speed at which the paper P is transported and a transport frequency of the stepping motor 107 are set according to the print rate of print data.

Also, the storage unit 102 stores control data for constant-speed phase associating a transport speed, a heat generating element energizing pulse width, and the number of energized heat generating element, as shown in FIG. 6. The control data for constant-speed phase is data for controlling the heat generating elements 111*a* during a constant-speed phase.

The transport speed refers to an available speed at which the paper P can be carried. Here, seven transport speeds are provided, including 14.0, 10.0, 8.0, 6.0, 4.0, 2.0, and 1.0 inches per second (IPS). The heat generating element energizing pulse width refers to the pulse width of the heat generation pulse (strobe time) supplied to the thermal head 111 from the head drive unit 110. The number of energized heat generating element blocks refers to the number of blocks of heat generating elements 111*a* driven by the head drive unit 110.

Also, the storage unit 102 stores control data for variable-speed phase associating transport speed ranges with heat generating element control information, as shown in FIG. 7. The control data for variable-speed phase is data for controlling the heat generating elements 111*a* when the transport speed changes.

The transport speed ranges include at least one or more intermediate speeds between a minimum value and a maximum value of the transport speed. Here, the available transport speed expressed by the transport speed data shown in FIG. 5 is defined as an intermediate speed, and the transport speed ranges are thus defined. In short, in this example, seven ranges are provided between the minimum value (0 IPS) and the maximum value (14.0 IPS) of the transport speed.

The heat generating element control information includes a heat generating element energizing pulse width and the number of energized heat generating element blocks. The number of energized heat generating element blocks refers to the number of blocks of heat generating elements 111*a* driven by the head drive unit 110, as in the control data for constant-speed phase.

The heat generating element energizing pulse width refers to the pulse width of the heat generation pulse signal (strobe time) supplied to the thermal head 111 from the head drive unit 110, and is predetermined according to an arithmetic formula. Here, the arithmetic formula multiplies the ratio of the transport frequency corresponding to the maximum value in the range of the current transport speed and the current transport frequency, by the pulse width of the heat generation pulse signal corresponding to that maximum value, and thus finds the pulse width of the heat generation pulse signal. For example, if the current transport speed is 10.0 IPS, which is included in the transport speed range of 10.0 to 14.0 IPS shown in FIG. 7, the ratio of the transport frequency (MF1) corresponding to the maximum value (14.0 IPS) in this range and the current transport frequency (10.0 IPS) is multiplied by the strobe time (ET1) of the heat generation pulse signal corresponding to this maximum value (14.0 (IPS)), thus finding the strobe time of the heat generation pulse signal supplied to the thermal head 111 from the head drive unit 110.

Furthermore, instead of an arithmetic formula, information for changing in stages the pulse width of the pulse signal which drives the heat generating elements 111*a* may be provided, as shown in FIG. 8. Specifically, the transport speed range of 10.0 to 14.0 IPS can be controlled in such a way that the transport speed is changed in predetermined eight steps. Accordingly, pulse widths (strobe times) ET11 to ET18 corresponding to the eight steps are set.

Turning back to FIG. 2, the control unit 101 includes a CPU (central processing unit), a RAM (random access memory) functioning as a working memory of the CPU, a timer and the like. Also, a part of the control unit 101 may be configured with a dedicated circuit such as an application specific integrated circuit (ASIC) or a field programmable gate array (FPGA).

The control unit 101 also functions as a print rate acquisition unit 101*a*, a target speed setting unit 101*b*, an intermediate speed acquisition unit 101*c*, and a heat generation control unit 101*d*, by executing a program stored in the storage unit 102. That is, in one embodiment, the control unit 101 is a processor that is programmed to carry out the functions of the print rate acquisition unit 101*a*, the target speed setting unit 101*b*, the intermediate speed acquisition unit 101*c*, and the heat generation control unit 101*d*. In another embodiment, the control unit 201 is a hardware controller, e.g., an ASIC or an FPGA, that is configured to carry out the functions of the print rate acquisition unit 101*a*, the target speed setting unit 101*b*, the intermediate speed acquisition unit 101*c*, and the heat generation control unit 101*d*.

The heat generation control carried out by the thermal printer 1 configured as described above will be described below, with reference to FIGS. 9 and 10.

The control unit 101 of the thermal printer 1 executes a program stored in the storage unit 102 in response to the operation of turning on the power of the thermal printer 1. Accordingly, the control unit 101 functions as the print rate acquisition unit 101*a*, the target speed setting unit 101*b*, the intermediate speed acquisition unit 101*c*, and the heat generation control unit 101*d*.

The print rate acquisition unit 101*a* acquires print data from an external device such as a POS terminal via the communication unit 105. The print rate acquisition unit 101*a* sets N expressing the current dot line to "N=0" (ACT11) at the timing when the print data is acquired, and subsequently sets N to "N=N+1" (ACT12).

The print rate acquisition unit 101*a* acquires the print rate of the N-th line of the print data (ACT13). The print rate in this case is the ratio of the number of print dots to the total number of dots in the dot line, i.e., a ratio of the number of heat generating elements 111*a* to be used to print the current line and the total number of heat generating elements 111*a*. In an initialization process after acquisition of the print data (N=1), the print rate acquisition unit 101*a* acquires the print rate of the first line of the print data.

The target speed setting unit 101*b* sets the transport speed and the transport pulse frequency corresponding to the print rate acquired by the print rate acquisition unit 101*a*, as the target transport speed and the transport pulse frequency, according to the transport speed data shown in FIG. 5 (ACT14). For example, if the print rate R acquired in ACT13 is included in a range of "Rb≤R≤Rc", 8.0 IPS corresponding to this print rate R is set as the target transport speed, and MF3 PPS is set as the transport pulse frequency.

The target speed setting unit 101*b* determines whether the set target transport speed is different from the current transport speed (ACT15). In the initialization processing (N=1) after the acquisition of the print data, the current transport speed is 0 (IPS) and therefore the target speed setting unit 101*b* determines that the transport speed needs to be changed (YES in ACT15). In this case, the intermediate speed acquisition unit 101*c* executes heat generation for variable-speed phase (ACT16).

Figure 10:
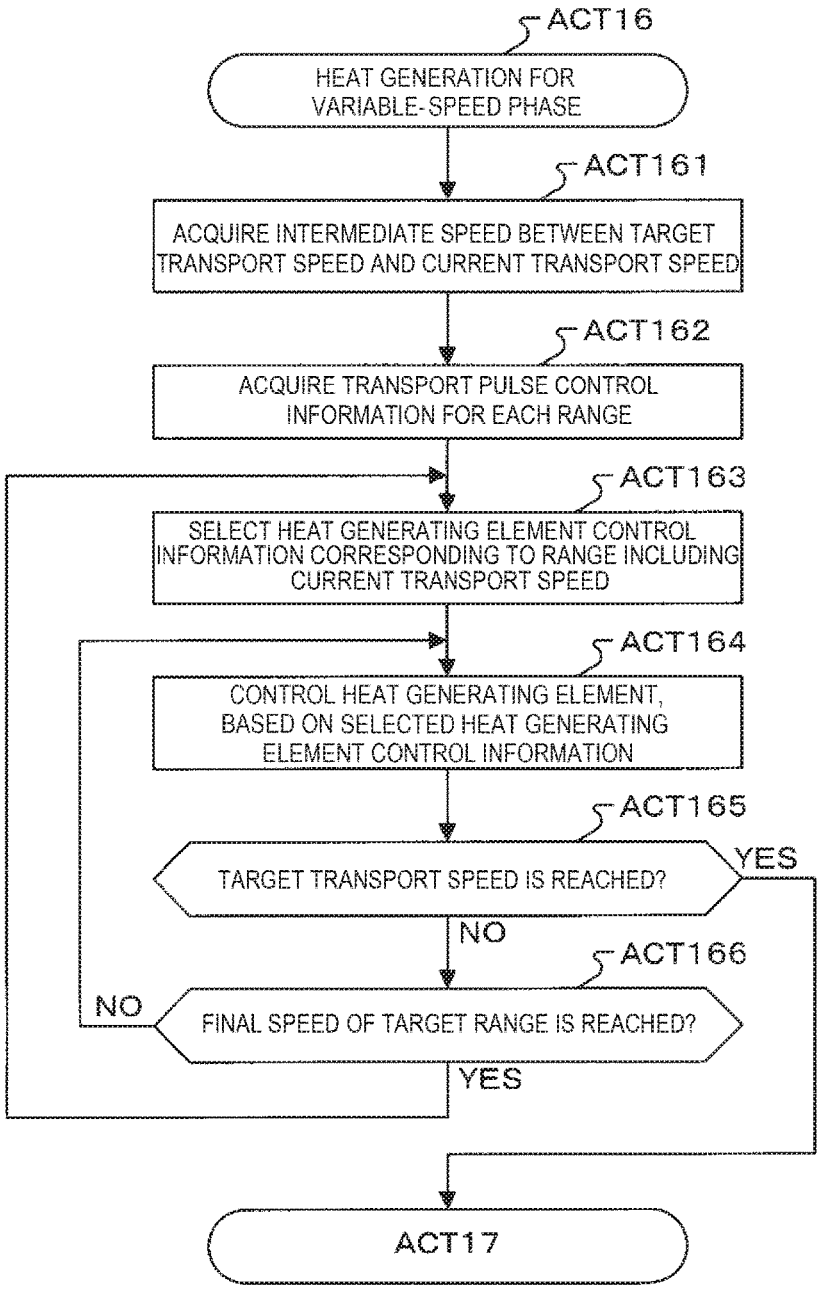
FIG. 10 is a flowchart illustrating a heat generation control process for variable-speed phase.

The heat generation for variable-speed phase process of Act is illustrated in FIG. 10. As shown in FIG. 10, the intermediate speed acquisition unit 101*c* acquires a predetermined intermediate speed between the target transport speed set by the target speed setting unit 101*b* and the current transport speed (ACT161). As the intermediate speed, 1.0, 2.0, 4.0, 6.0, 8.0, 10.0, and 14.0 (IPS) are defined. Therefore, here, the intermediate speed acquisition unit 101*c* acquires 1.0, 2.0, 4.0, and 6.0 (IPS) as the intermediate speed.

The heat generation control unit 101*d* selects each of the ranges between the current transport speed to the target transport speed corresponding to the intermediate speeds acquired by the intermediate speed acquisition unit 101*c*, referring to the control data for variable-speed phase shown in FIG. 7, and thus acquires heat generating element control information for each of the ranges (ACT162). Since the current transport speed is 0 (IPS) and the target transport speed is set to 8.0 (IPS), the heat generation control unit 101*d* acquires the heat generating element control information set for each of the ranges No. 3 to No. 7.

Then, the heat generation control unit 101*d* selects the heat generating element control information corresponding to the range including the current transport speed, from among the heat generating element control information acquired in ACT162 (ACT163). If the current transport speed is 0 (IPS), the heat generation control unit 101*d* selects the heat generating element control information corresponding to the range No. 7.

The heat generation control unit 101*d* controls the heat generating elements 111*a*, based on the selected heat generating element control information (ACT164). Specifically, the heat generation control unit 101*d* finds the pulse width of the heat generation pulse signal (strobe time) corresponding to the range No. 7 by the arithmetic formula "(MF7/Current MF)×ET7". Also, the number of energized heat generating element blocks in the range No. 7 is "4". Therefore, the heat generation control unit 101*d* drives the heat generating elements 111*a* corresponding to four (all) blocks, based on the heat generation pulse signal with the pulse width thus found.

The heat generation control unit 101*d* determines whether the target transport speed or the final speed of the target range is reached or not (ACT165, ACT166). If it is determined that the final speed of the target range is reached (YES in ACT166), the heat generation control unit 101*d* returns to ACT163. In this case, the heat generation control unit 101*d* selects the heat generating element control information corresponding to the next range (range including the current transport speed) and carries out processing similar to the above, in ACT164. For example, if 1.0 IPS, which is the final speed of the range No. 7, is reached, the heat generation control unit 101*d* carries out processing to control the heat generating elements 111*a*, based on the heat generating element control information corresponding to the range No. 2.

The heat generation control unit 101*d* repeats the processing of ACT163 to ACT166 and thus controls the heat generating elements 111*a*, based on the heat generating element control information corresponding to each range, until the transport speed of the paper P reaches the target transport speed (8.0 (IPS)). Then, if the target transport speed is reached (YES in ACT165), the heat generation control unit 101*d* shifts to ACT16 shown in FIG. 9.

Figure 9:
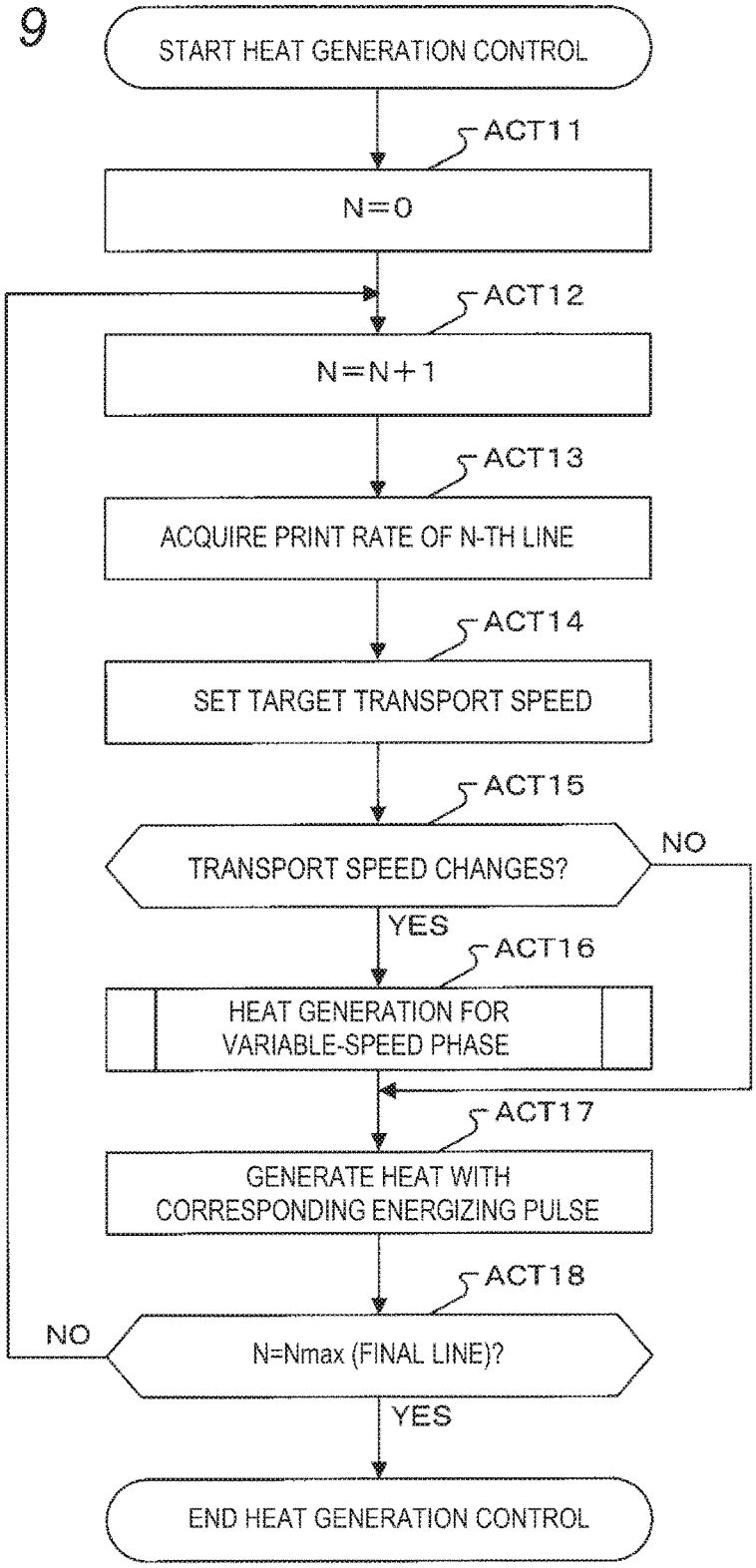
FIG. 9 is a flowchart illustrating a heat generation control process.

Back to FIG. 9, if it is determined in ACT15 that the transport speed does not change (NO in ACT15), or after the processing of ACT16 is carried out, the heat generation control unit 101*d* controls the heat generating elements 111*a* until the printing of the N-th line is finished, based on the heat generation pulse signal with the pulse width corresponding to the current transport speed (predetermined speed) of the control data for constant-speed phase shown in FIG. 6 and the set number of blocks.

Subsequently, the heat generation control unit 101*d* determines whether N is the final line or not (ACT18). If N is not the final line, the heat generation control unit 101*d* returns to ACT12, increments N, and carries out processing similar to the above (NO in ACT18). Meanwhile, if N is the final line, the heat generation control unit 101*d* ends the heat generation control (YES in ACT18).

The thermal printer 1 according to the embodiment acquires at least one or more predetermined intermediate speeds between a target transport speed and the current transport speed, and controls the heat generating elements 111*a* until the transport speed of the paper P reaches the target transport speed, based on the heat generating element control information for each of the ranges from the current transport speed to the target transport speed, divided by the acquired intermediate speeds. Thus, the number of pieces of heat generating element control information processed until the target transport speed is reached can be reduced while the number of available transport speeds is maintained.

The embodiment is an example and various changes and applications are possible.

For example, the heat controller according to the embodiment may be configured as a device which is independent of the heat generating elements 111*a*. Also, the heat generation controller may be provided with a POS terminal or an ATM (automated teller machine) terminal.

In the embodiment, an example in which all of the available transport speeds are defined as intermediate speeds is described. However, it is possible to employ a part of these available transport speeds. For example, 4.0, 6.0, and 10.0 IPS shown in FIG. 5 may be defined as intermediate speeds. Also, speeds other than the available transport speeds (such as 3.0, 5.0, and 7.0 IPS) may be defined as intermediate speeds.

In the arithmetic formula to find the heat generating element energizing pulse width in the embodiment, the transport frequency corresponding to the maximum value of the transport speed and the pulse width of the heat generation pulse signal (strobe time) are used. However, a transport frequency and a pulse width corresponding to a value (minimum value or average value) other than the maximum value of the transport speed may be used.

In the embodiment, an example in which a target transport speed is decided according to the print rate is described. However, the target transport speed may be set, based on the combination of the print rate and another criterion, or based on a criterion that does not include the print rate. As another criterion, for example, the number of driven blocks when the heat generating elements 111*a* of the thermal head 111 are driven on a block basis may be employed.

In the embodiment, the thermal printer with the roll paper PR stored therein is described as an example. However, the heat generation control device may be configured to control heat generating elements which print on a regular-sized paper or a folded continuous sheet.

While the embodiment is described above, the embodiment is presented as an example and not intended to limit the scope of the invention. This novel embodiment can be carried out in various other configurations. Various omission, replacements, and changes can be made without departing from the spirit of the invention. The embodiment and modifications thereof are included in the scope and spirit of the invention and also included in the scope of the invention and equivalents thereof described in the claims.

What is claimed is:

1. A thermal printer comprising:

a communication interface configured to receive print data from an external device;

a thermal print head configured to thermally print on a sheet, line by line according to the received print data;

a motor configured to drive a roller to transport the sheet, line by line according to the received print data; and a processor configured to:

determine, for a current print line, a target transport speed for transporting the sheet, retrieve one or more intermediate speeds that are defined in advance and are between a current transport speed of transporting the sheet and the target transport speed, retrieve, for each determined intermediate speed, predetermined heating control information for heating the thermal print head, control the motor to transport the sheet at each determined intermediate speed and the target transport speed, sequentially, and control the thermal print head to be heated in accordance with the predetermined heating control information corresponding to the determined intermediate speed closest to the current speed.

2. The thermal printer according to claim 1, wherein the processor determines the target transport speed based on a print rate of the current print line.

3. The thermal printer according to claim 2, further comprising:

a storage unit that stores a plurality of transport speeds each in association with a different print rate range, wherein the processor determines the target transport speed as the transport speed that is stored in association with the print rate range that corresponds to the determined print rate of the current print line.

4. The thermal printer according to claim 3, wherein:

the storage unit further stores a plurality of predetermined heating control information each in association with a different transport speed range, and the processor retrieves the one or more intermediate speeds as one intermediate speed in each stored transport speed range between the current transport speed and the target transport speed, and controls thermal print head to be heated in accordance with the predetermined heating control information by applying a control signal based on the predetermined heating control information associated with the corresponding transport speed range.

5. The thermal printer according to claim 4, wherein each predetermined heating control information defines a pulse width.

6. The thermal printer according to claim 5, wherein the pulse width is calculated according to a ratio of an upper transport speed of the range to the current speed multiplied by a stored pulse width associated with the corresponding intermediate speed.

7. The thermal printer according to claim 1, wherein the print head includes a plurality of heat generating elements arranged in a direction orthogonal to a sheet transport direction.

8. The thermal printer according to claim 7, wherein the print rate is a ratio of the number of heat generating elements to be used to print the current line and the total number of heat generating elements.

9. The thermal printer according to claim 6, wherein the sheet is roll paper.

10. The thermal printer according to claim 1, further comprising:

a speed reduction mechanism configured to transfer rotation force of the motor to the roller.

11. A method of controlling a thermal printer comprising:

receiving print data from an external device;

determining, for a current print line to be thermally printed on a sheet by a thermal print head, a target transport speed for transporting the sheet;

retrieving one or more intermediate speeds that are defined in advance and are between a current transport speed of transporting the sheet and the target transport speed;

retrieving, for each determined intermediate speed, predetermined heating control information for heating the thermal print head;

controlling a motor to transport the sheet at each determined intermediate speed and the target transport speed, sequentially; and controlling the thermal print head to be heated in accordance with the predetermined heating control information corresponding to the determined intermediate speed closest to the current speed.

12. The method according to claim 11, wherein the target transport speed is determined based on a print rate of the current print line.

13. The method according to claim 12, further comprising:

storing a plurality of transport speeds each in association with a different print rate range, wherein the target transport speed is determined as the transport speed that is stored in association with the print rate range that corresponds to the determined print rate of the current print line.

14. The method according to claim 13, further comprising:

storing a plurality of predetermined heating control information each in association with a different transport speed range, wherein:

the one or more intermediate speeds are determined as one intermediate speed in each stored transport speed range between the current transport speed and the target transport speed, and the thermal print head is controlled to be heated in accordance with the predetermined heating control information by applying a control signal based on the predetermined heating control information associated with the corresponding transport speed range.

15. The method according to claim 14, wherein each predetermined heating control information defines a pulse width.

16. The method according to claim 15, wherein the pulse width is calculated according to a ratio of an upper transport speed of the range to the current speed multiplied by a stored pulse width associated with the corresponding intermediate speed.

17. The method according to claim 11, wherein the print head includes a plurality of heat generating elements arranged in a direction orthogonal to a sheet transport direction.

18. The method according to claim 17, wherein the print rate is a ratio of the number of heat generating elements to be used to print the current line and the total number of heat generating elements.

19. The method according to claim 16, wherein the sheet is roll paper.

20. The method according to claim 11, wherein a speed reduction mechanism transfers rotation force of the motor to the roller.

* * * * *